US008235614B2

(12) United States Patent
Takata et al.

(10) Patent No.: US 8,235,614 B2
(45) Date of Patent: Aug. 7, 2012

(54) IMAGE PROCESSING DEVICES AND SHEET FEEDING DEVICES

(75) Inventors: Masayuki Takata, Nagoya (JP); Yoshikazu Takahashi, Nagoya (JP); Kazama Goto, Nagoya (JP); Naoya Okazaki, Gifu (JP)

(73) Assignee: Brother Kogyo Kabushiki Kaisha, Nagoyo-shi, Aichi-ken (JP)

( * ) Notice: Subject to any disclaimer, the term of this patent is extended or adjusted under 35 U.S.C. 154(b) by 579 days.

(21) Appl. No.: 12/413,239

(22) Filed: Mar. 27, 2009

(65) Prior Publication Data

US 2009/0245907 A1 Oct. 1, 2009

(30) Foreign Application Priority Data

Mar. 29, 2008 (JP) ..... 2008-088933

(51) Int. Cl.

| | |
|---|---|
| ***G03G 15/00*** | (2006.01) |
| ***B41J 29/02*** | (2006.01) |
| ***B65H 29/54*** | (2006.01) |
| ***B65H 29/68*** | (2006.01) |
| ***B65H 29/00*** | (2006.01) |
| ***B65H 31/00*** | (2006.01) |

(52) U.S. Cl. ..... 400/693; 399/405; 271/306; 271/182; 271/184; 271/207

(58) Field of Classification Search ..... 400/693; 399/405; 271/306, 182, 184, 207
See application file for complete search history.

(56) References Cited

U.S. PATENT DOCUMENTS

2004/0086311 A1* 5/2004 Baba ..... 399/405
2006/0024116 A1* 2/2006 King et al. ..... 400/624

FOREIGN PATENT DOCUMENTS

| | | | |
|---|---|---|---|
| JP | S56-10452 | U | 1/1981 |
| JP | S61-165956 | U | 10/1986 |
| JP | H05-208770 | A | 8/1993 |
| JP | H06-024621 | A | 2/1994 |
| JP | H06-312549 | A | 11/1994 |
| JP | H08-217312 | A | 8/1996 |
| JP | 2002-302325 | A | 10/2002 |
| JP | 2004-224490 | A | 8/2004 |

OTHER PUBLICATIONS

Japan Patent Office; Notice of Reasons for Rejection in Japanese Patent Application No. 2008-088933 (counterpart to the above captioned US application) mailed May 25, 2010.

* cited by examiner

*Primary Examiner* — Michael G Lee
*Assistant Examiner* — Laura Gudorf
(74) *Attorney, Agent, or Firm* — Baker Botts L.L.P.

(57) ABSTRACT

An image forming apparatus including an image forming portion that forms an image on a surface of a sheet, a feeding device that feeds the sheet in a sheet feeding direction, a sheet receiving portion, and an engagement portion selectively moves between a first position and a second position. When the engagement portion is in the first position, the engagement portion engages the leading end of the sheet. When the engagement portion is in the second position, the engagement portion does not engage the sheet. When the engagement portion is in the first position, the engagement portion engages a leading end of the sheet before a trailing end of the sheet passes the feeding device. The sheet receiving portion receives the sheet after the engagement portion engages the leading end of the sheet.

12 Claims, 16 Drawing Sheets

IMAGE PROCESSING DEVICES AND SHEET FEEDING DEVICES

CROSS REFERENCE TO RELATED APPLICATION

The present application claims priority from Japanese Patent Application No. 2008-088933, which was filed on Mar. 29, 2008, the disclosure of which is incorporated herein by reference in its entirety.

BACKGROUND OF THE INVENTION

1. Field of the Invention

The present invention relates to image forming apparatus, such as printers, facsimile machines, and copiers, and more particularly to image forming apparatus configured to output a sheet containing an image formed thereon.

2. Description of Related Art

A known image forming apparatus, e.g., the image forming apparatus described in Japanese Laid-Open Patent Publication No. 5-208770, comprises a sheet output mechanism configured to turn a sheet while outputting the sheet, such that the sheet's printed surface may face up or down.

The known image forming apparatus includes a sheet output path disposed inside an apparatus body. The sheet output path is shaped in a loop curved at a predetermined curvature. A sheet is turned upside down in the sheet output path and output from the image forming apparatus. In the known image forming apparatus, the loop-shaped sheet output path needs to be disposed inside the apparatus body and a drive mechanism needs to be provided to turn a sheet upside down, which result in the increase in the size and costs of the apparatus.

The sheet output mechanism of the known image forming apparatus can not be utilized in small printers, e.g., the wall mountable printers described in Japanese Laid-Open Patent Publication No. 2002-302325, which are designed for space saving. Thus, small printers can not perform sheet turning while outputting a printed sheet.

SUMMARY OF THE INVENTION

Therefore, a need has arisen for image forming apparatuses which overcome these and other shortcomings of the related art. When an image forming apparatus is shared by people, needs arise for the image forming apparatus to output a sheet with a printed surface facing down to keep image information formed on the sheet private. Needs also arise for image forming apparatus to output a sheet with a printed surface facing up to provide instant viewing of image information on the printed surface of the sheet. A technical advantage of the present invention is that an image forming apparatus outputs a sheet while turning the sheet, such that a printed surface of the sheet may face up or down, without increasing the size and costs of the apparatus, and without requiring a special drive mechanism.

According to an embodiment of the invention, an image forming apparatus comprising an image forming portion configured to form an image on a surface of a sheet having a leading end and a trailing end opposite the leading end, a feeding device configured to feed the sheet in a sheet feeding direction and to output the sheet through an output opening positioned in the image forming apparatus and downstream from the feeding device in the sheet feeding direction, an output direction regulating device configured to guide the sheet in an output direction as the sheet is output through the output opening, a sheet receiving portion positioned downstream of the output opening in the sheet feeding direction, and an engagement portion positioned in a portion of a sheet output path downstream from the output opening and upstream from the sheet receiving portion in the sheet feeding direction and configured to selectively move between at least a first position and a second position. When the engagement portion is in the first position, the engagement portion engages the leading end of the sheet when the sheet reaches the engagement portion, and when the engagement portion is in the second position, the engagement portion does not engage the sheet when the sheet reaches the engagement portion. When the engagement portion is in the first position, the engagement portion is configured to engage the leading end of the sheet before the trailing end passes the feeding device, and the sheet receiving portion is configured to receive the sheet after the engagement portion engages the leading end of the sheet.

Other objects, features, and advantages of embodiments of the present invention will be apparent to persons of ordinary skill in the art from the following description of preferred embodiments with reference to the accompanying drawings.

BRIEF DESCRIPTION OF THE DRAWINGS

For a more complete understanding of the present invention, the needs satisfied thereby, and the objects, features, and advantages thereof, reference now is made to the following description taken in connection with the accompanying drawings.

DETAILED DESCRIPTION OF EMBODIMENTS OF THE INVENTION

Embodiments of the present invention and their features and technical advantages may be understood by referring to FIGS. 1-16, like numerals being used for like corresponding portions in the various drawings.

Figure 1:
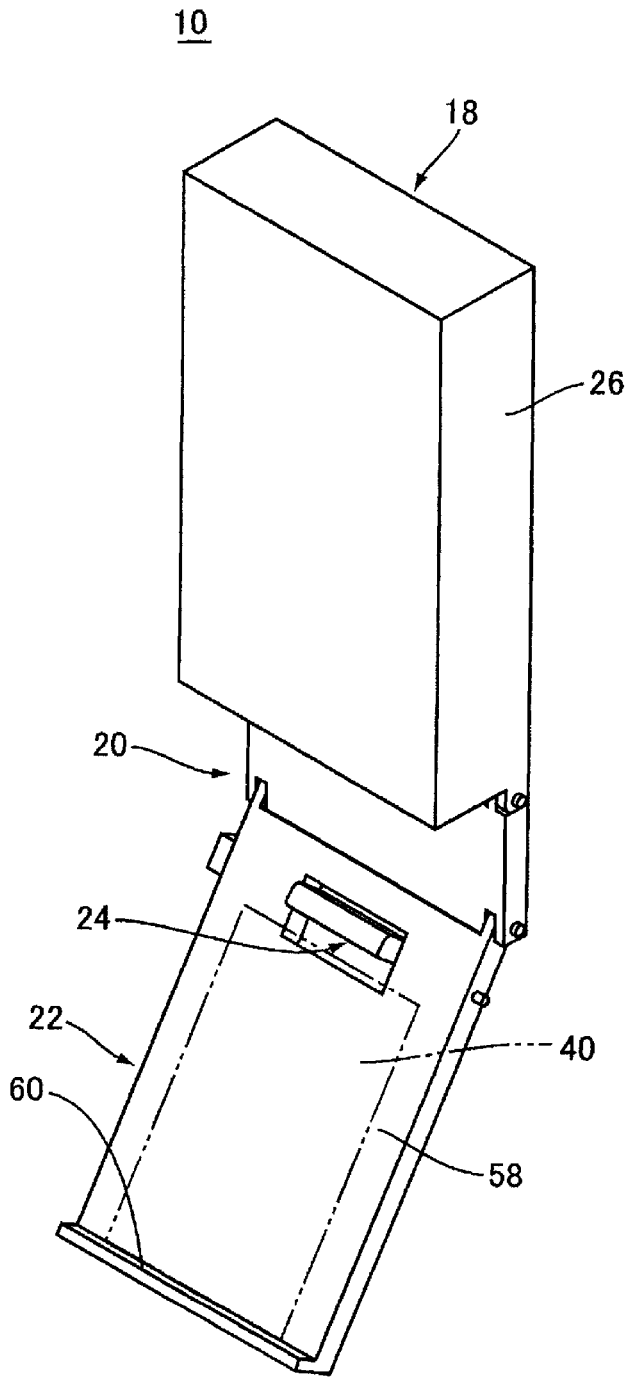
FIG. 1 is a perspective view of an image forming apparatus according to an embodiment of the invention.
Figure 2:
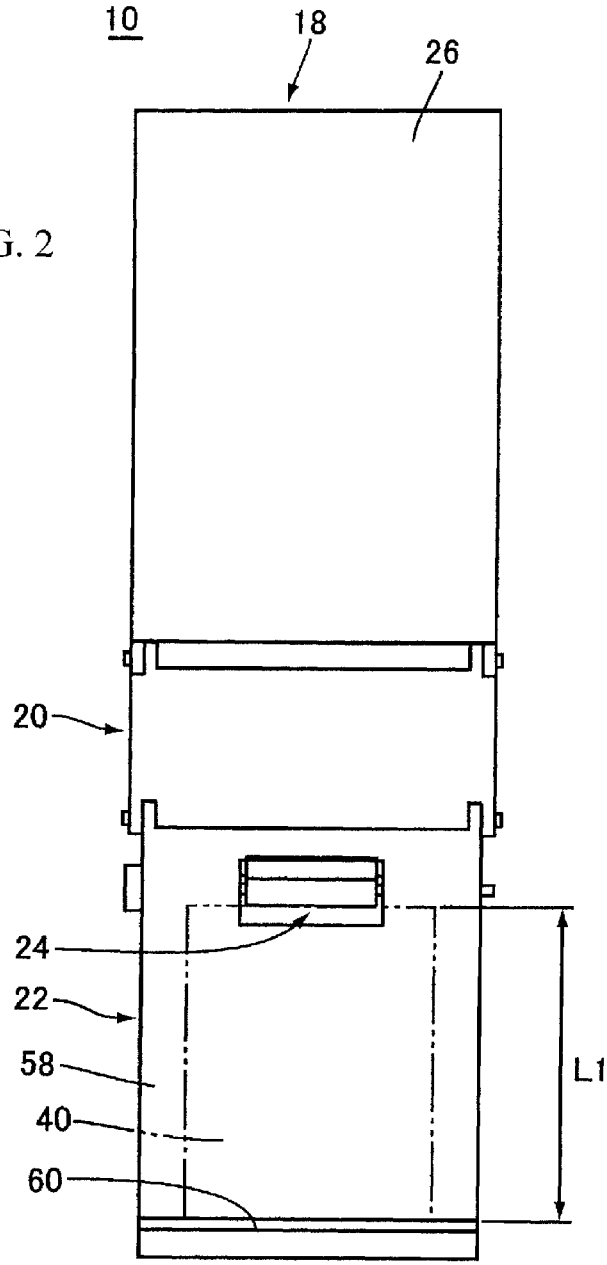
FIG. 2 is a front view of the image forming apparatus according to the embodiment of FIG. 1.
Figure 3:
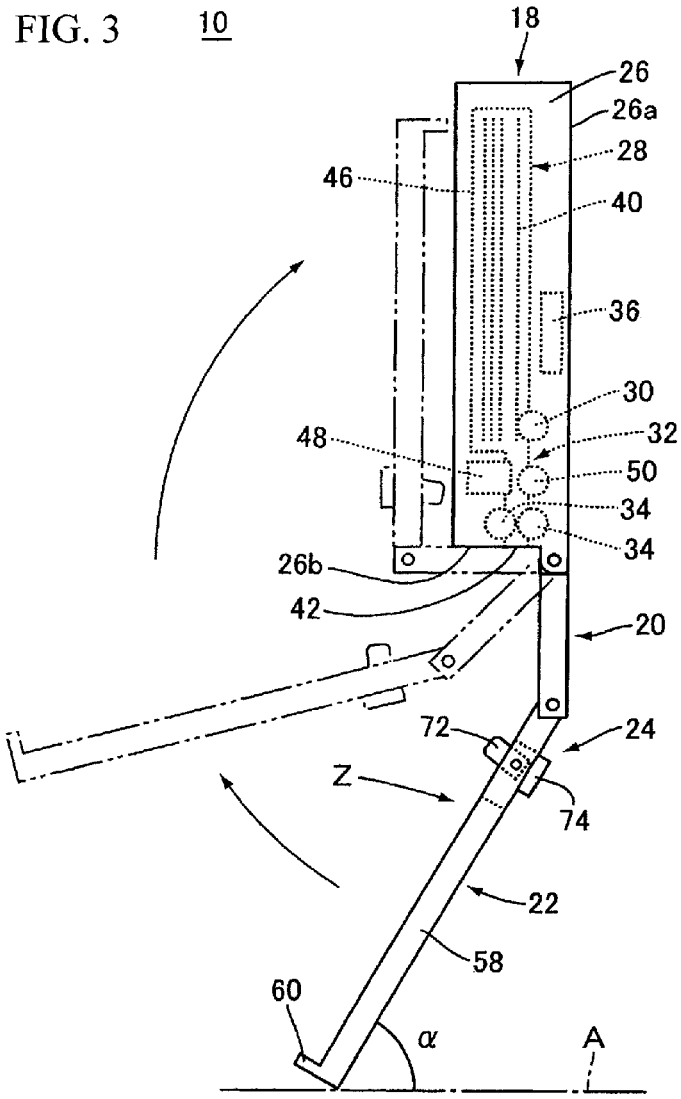
FIG. 3 is a side view of the image forming apparatus according to the embodiment of FIG. 1.
Figure 6:
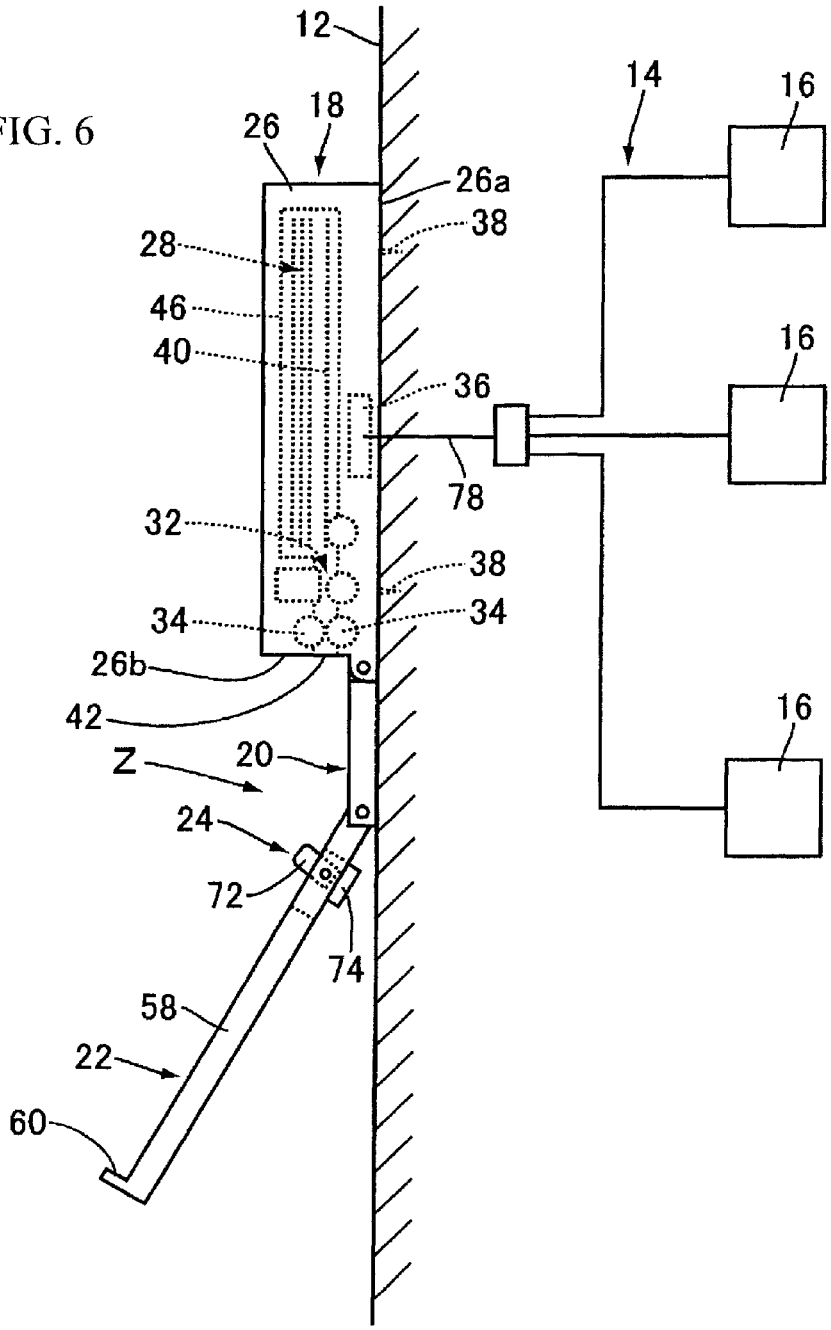
FIG. 6 is a schematic depicting an operation of the image forming apparatus according to the embodiment of FIG. 1.
Figure 7:
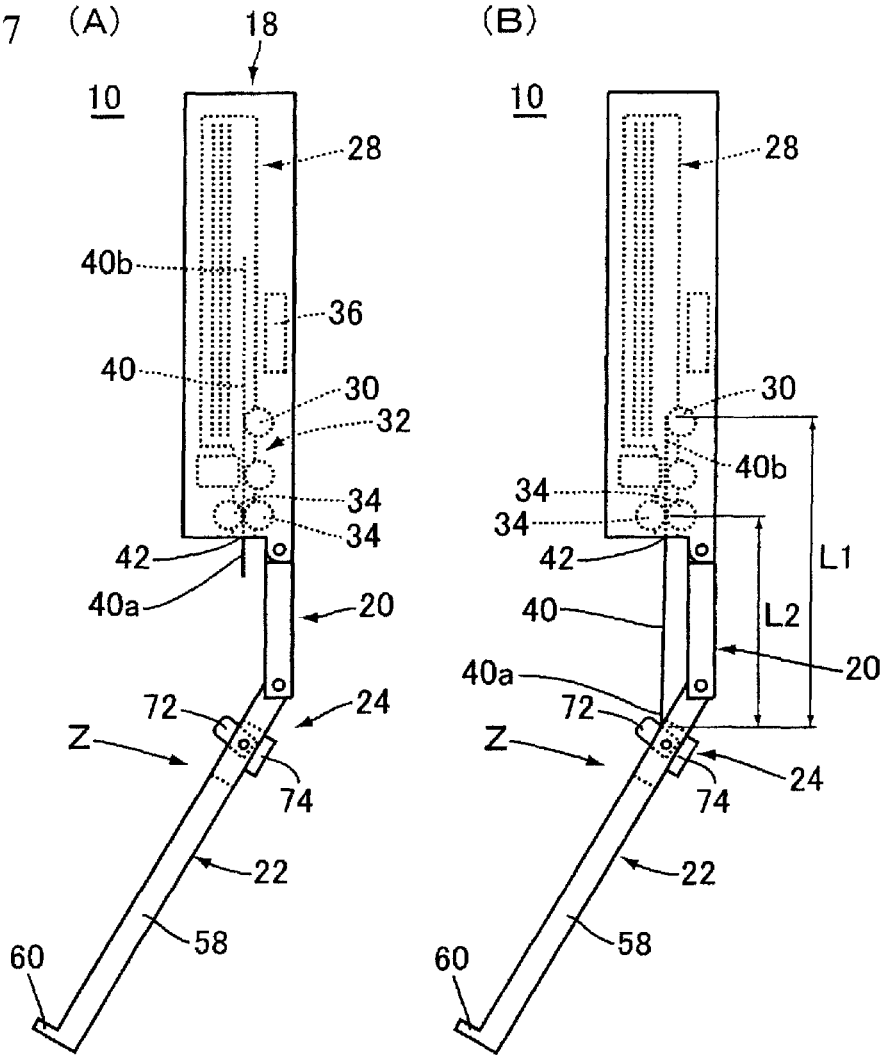
FIG. 7A is a schematic depicting a sheet flipping output operation of the image forming apparatus according to the embodiment of FIG. 1 in which a sheet is output through an output opening of the image forming apparatus.
FIG. 7B is another schematic depicting the sheet flipping output operation of the image forming apparatus according to the embodiment of FIG. 1 in which the sheet contacts an engagement portion.
Figure 8:
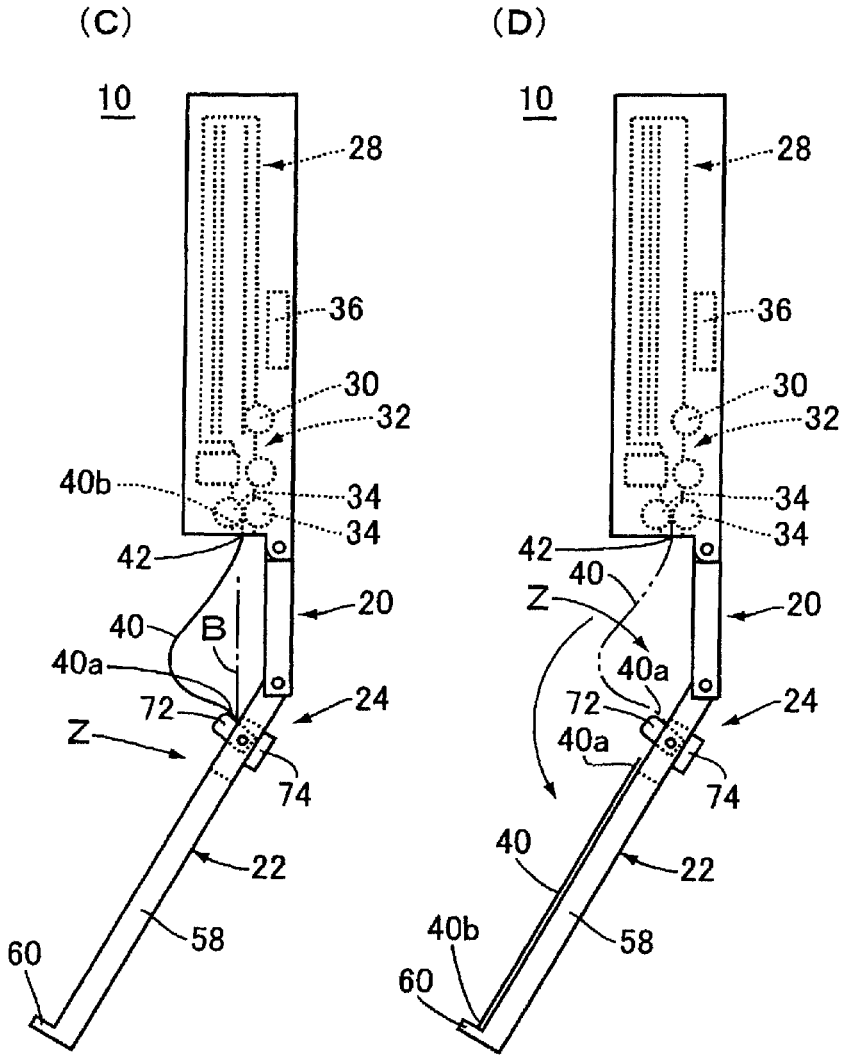
FIG. 8C is yet another schematic depicting the sheet flipping output operation of the image forming apparatus according to the embodiment of FIG. 1 in which the sheet is forcibly flexed.
FIG. 8D is still another schematic depicting the sheet flipping output operation of the image forming apparatus according to the embodiment of FIG. 1 in which the sheet is flipped over onto a sheet receiving portion.

Referring to FIGS. 1 and 6, an image forming apparatus 10 may be a wall-mountable printer which may be mounted to a vertical surface 12, e.g., a wall in a room, according to an embodiment of the invention. Image forming apparatus 10 may be shared among personal computers 16 via a network 14. Referring to FIGS. 1-3, image forming apparatus 10 may comprise a main unit 18, a connecting plate 20, a sheet receiving portion 22, and an engagement mechanism 24.

Main unit 18 may comprise a case 26 in which a sheet accommodating portion 28, a feed roller 30, an image forming portion 32, a pair of output rollers 34 and a controller 36, as shown in FIG. 3.

Figure 4:
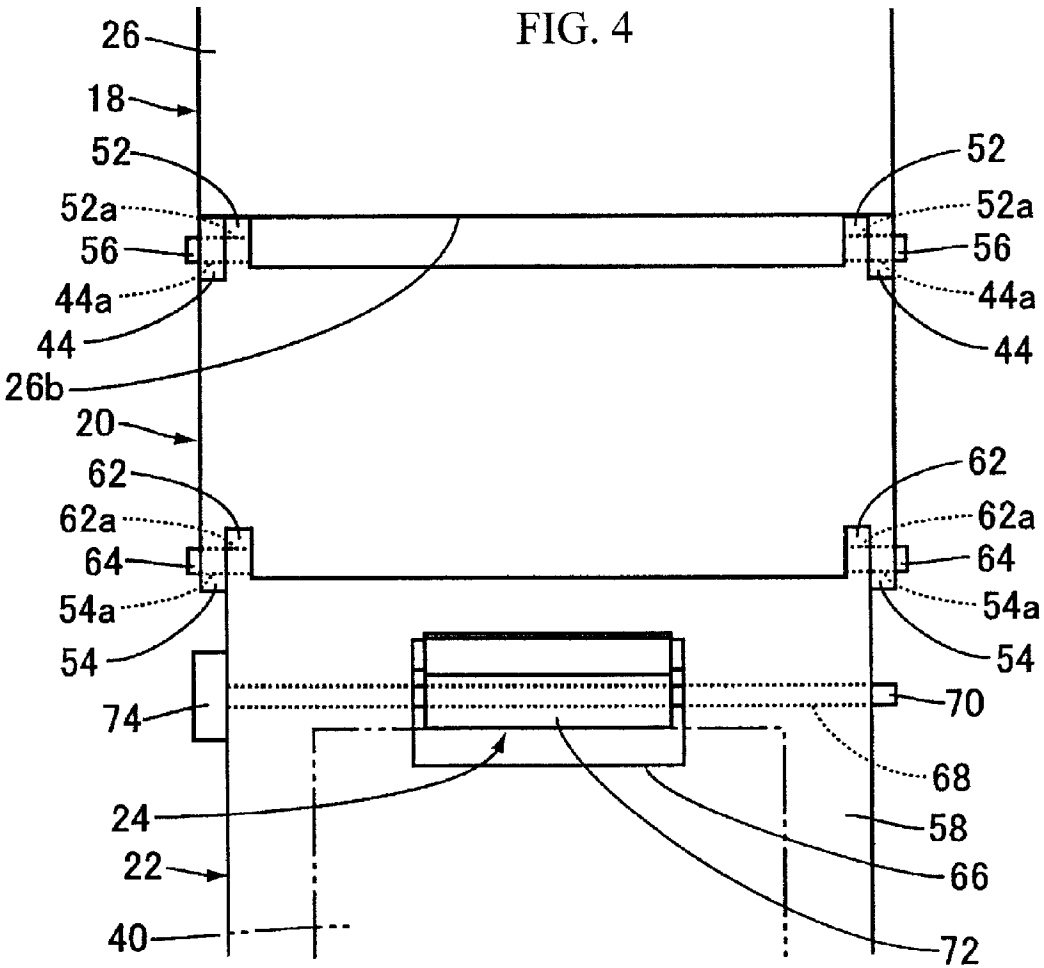
FIG. 4 is an enlarged view of a connecting plate and a sheet receiving portion of the image forming apparatus according to the embodiment of FIG. 1.

Case 26 may have a generally rectangular parallelepipedal shape elongated in a vertical direction. A rear surface 26*a* of case 26 may have holes (not shown) through which screws 38 may be fastened to fix case 26 to vertical surface 12, as shown in FIG. 6. A lower surface 26*b* of case 26 may comprise an output opening 42 through which a sheet 40 may be output. Referring to FIG. 4, a bearing portion 44 may comprise a bearing hole 44*a* and may be disposed at both ends of lower surface 26*b* in a width direction. Bearing portion 44 may extend downward from lower surface 26*b*

Referring to FIG. 3, sheet accommodating portion 28 may comprise an accommodating space 46 in which a stack of sheets 40 may be held, such that the surfaces of the stack of sheet 40 may be substantially in parallel with rear surface 26*a*. An elastic member (not shown), e.g., a spring, may be disposed inside accommodating space 46 and may be configured to press sheets 40 toward rear surface 26*a* to keep sheet 40 in place.

Feed roller 30 may be configured to pick up and feed sheets 40 held in accommodating space 46 to image forming portion 32 one at a time in a sheet feeding direction. Feed roller 30 may be disposed at a position facing accommodating space 46, and may extend in a width direction of case 26, e.g., right-left direction in FIG. 2. Sheets 40 held in accommodating space 46 may be pressed against feed roller 30 by the elastic member.

Image forming portion 32 may be configured to form images on surfaces of sheets 40 fed by feed roller 30. Image forming portion 32 may comprise a print head 48 disposed at a lower portion of sheet accommodating portion 28 facing rear surface 26*a*, and a platen roller 50 disposed at a position facing print head 48. A surface of sheet 40 facing print head 48 may be an upper surface, e.g., print surface, on which an image may be formed. In a sheet flipping output operation, sheet 40 may be output with the upper surface of sheet 40 facing toward an output tray, e.g., hidden from instant viewing.

A pair of output rollers 34 may be configured to hold and output sheets 40 through output opening 42. Output rollers 34 may be configured to regulate an output direction of sheet 40. Output rollers 34 may be disposed at a position adjacent to output opening 42 and downstream of image forming portion 32 in the sheet feeding direction. The output direction of sheet 40 may be a vertically downward direction. Sheets 40 output from output opening 42 may be fed to an engagement portion 72, which may be disposed at a position downstream of output rollers 34 in the sheet feeding direction. Engagement portion 72 may be disposed in an output path of sheet 40.

Output rollers 34 may function as the feeding device and the output direction regulating device. In another embodiment, one component may function as the feeding device and another component may function as the output direction regulating device. For example, a slider may function as the feeding device and may be configured to feed sheets 40 in the sheet feeding direction while holding or pinching sheets 40. A guide may function as the output direction regulating device and may be configured to guide sheets 40 through output opening 42 in a predetermined direction.

Referring to FIG. 6, controller 36 may comprise a central processing unit (CPU) configured to perform computations, a storage device, e.g., a memory, configured to store various information therein, and an interface configured to exchange information with PCs 16. The CPU may be connected to feed roller 30, image forming portion 32, output rollers 34, and a drive portion 74 of engagement mechanism 24.

Connecting plate 20 may be a plate member and may function as a connecting portion connecting main unit 18 and sheet receiving portion 22. Connecting plate 20 may also function as a flexing direction regulating device configured to regulate a flexing direction of sheets 40 when sheets 40 are output through output opening 42. Referring to FIG. 2, connecting plate 20 may have a width in a width direction, e.g., right-left direction in FIG. 2, substantially the same as a width of main unit 18. Referring to FIG. 3, connecting plate 20 may have a length, e.g., in the vertical direction in FIG. 3, greater than the thickness, e.g., right-left direction in FIG. 3, of main body 18.

Referring to FIG. 4, a bearing portion 52 may be disposed at each upper ends of connection plate 20 in a width direction. Bearing portion 52 may comprise a bearing hole 52*a* and may extend upward from the each upper end of connecting plate 20. A bearing portion 54 may be disposed at each lower ends of connection plate in the width direction. Bearing portion 54 may comprise a bearing hole 54*a*, and may extend downward from the each lower end of connecting plate 20. Bearing portion 44 of main unit 18 and bearing portion 52 of connecting plate 20 may be pivotally coupled by a rotating shaft 56, such that the angle between connecting plate 20 and a horizontal surface A may be adjusted between 0 and 90 degrees, as shown in FIG. 3.

Sheet receiving portion 22 may be disposed at a position downstream output opening 42 and connecting plate 20 in the sheet feeding direction. Sheet receiving portion 22 may be configured to receive sheets 40 output through output opening 42. Sheet receiving portion 22 may comprise a plate-shaped output tray 58. Referring to FIG. 2, output tray 58 may have a width in the width direction, e.g., right-left direction in FIG. 2, substantially the same as a width of main unit 18. Output tray 58 may have a length longer than dimension L1 of sheet 40 in the output direction. An extended portion 60 may be disposed at an lower end of output tray 58 extending along the width direction of output tray 58, and may protrude from an upper surface of output tray 58. Extended portion 60 may be configured to receive lower ends of sheets 40.

Referring to FIG. 4, a bearing portion 62 may be disposed at each of upper ends of output tray in the width direction. Bearing portion 62 may comprise a bearing hole 62*a* and may extend upward from an upper end of output tray 58. Bearing portion 54 of connecting plate 20 and bearing portion 62 of output tray 58 may be pivotally coupled by inserting a rotating shaft 64 through bearing holes 54*a* and 62*a*. An accommodation hole 66 may be disposed in an upper portion of output tray 58. Accommodation hole 66 may be configured to accommodate engagement portion 72 of engagement mechanism 24 therein. A through hole 68 may be disposed in an upper portion of output tray 58 and may pass through output tray 58 along the width direction, as shown in FIG. 4.

When image forming apparatus 10 is in operation, the angle of connecting plate 20 with respect to horizontal surface A may be set to 90 degrees and an angle α of output tray 58 with respect to horizontal surface A may be set to a predetermined angle suitable for outputting sheets 40, as shown by solid lines in FIG. 3. A sheet output path Z from output opening 42 to sheet receiving portion 22 may be formed. When image forming apparatus 10 is not in operation, connecting plate 20 and output tray 58 may fold in two steps to cover main unit 18, as shown by dashed lines in FIG. 3. Thus, an overall size of image forming apparatus 10 may be reduced.

When image forming apparatus is in operation, angle α of output tray 58 may be set between 0 and 80 degrees for smooth flipping of sheets 40 and to prevent sheets 40 from falling off output tray 58.

Figure 5:
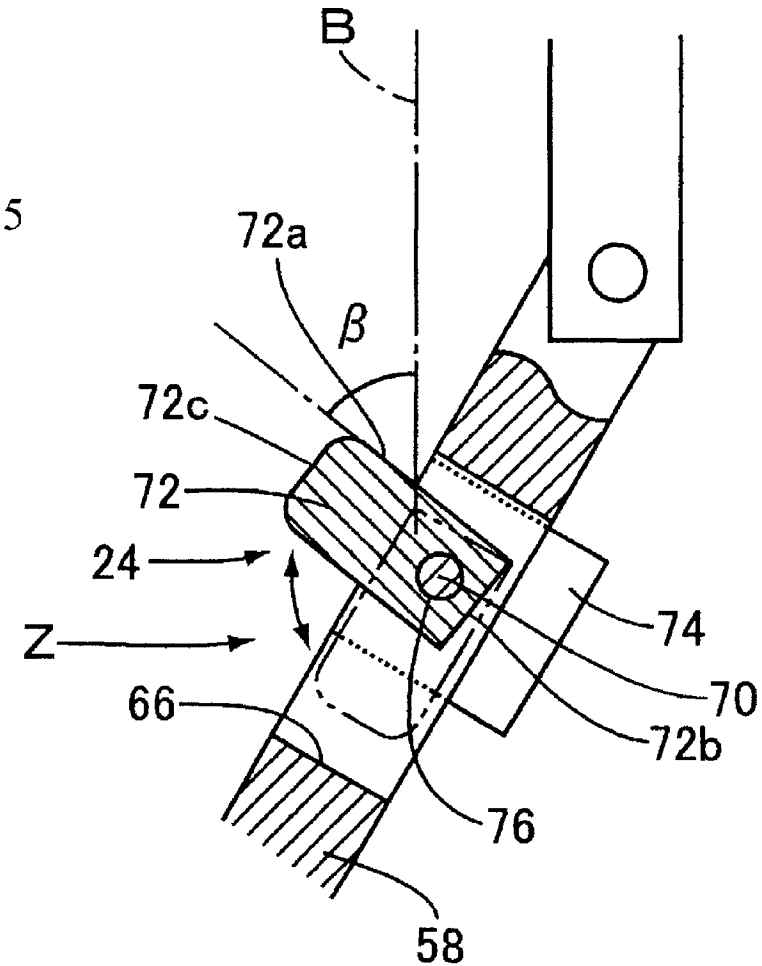
FIG. 5 is an enlarged cross-sectional view of an engagement mechanism of the image forming apparatus according to the embodiment of FIG. 1.

Referring to FIGS. 4 and 5, engagement mechanism 24 may be disposed in an upper portion of output tray 58 at a position downstream from connecting plate 20 in the sheet feeding direction. Engagement mechanism 24 may comprise a rotating shaft 70 inserted through hole 68 of output tray 58, an engagement portion 72 mounted on rotating shaft 70 in accommodation hole 66 of output tray 58, and a drive portion 74 mounted to rotating shaft 70 at one end of output tray 58 in its width direction.

Referring to FIG. 5, engagement portion 72 may be a plate member having generally a rectangular cross-sectional shape. Engagement portion 72 may comprise an engagement surface 72*a* where a leading end 40*a* of sheet 40 in the output direction may contact, as shown in FIG. 7B. Engagement portion 72 may comprise a through hole 76 configured to receive rotating shaft 70 therethrough. Through hole 76 may extend in a longitudinal direction of engagement portion 72. Through hole 76 may be disposed at a positioned closer to a shorter side 72*b* of engagement potion 72 than to a middle portion of engagement portion 72. When drive portion 74 rotates rotating shaft 70, engagement portion 72 may pivot about through hole 76 in a predetermined direction and at a predetermined angle. Accordingly, a portion of engagement portion 72 including shorter side 72C may protrude toward sheet output path Z or may move away from output path Z and be accommodated in accommodation hole 66.

Drive portion 74 may comprise a motor (not shown) configured to apply rotational force to rotating shaft 70. Operations of the motor may be controlled based on drive signals transmitted from controller 36 which controls pivoting directions and angles of engagement portion 72. Controller may cause the motor to protrude engagement portion 72 toward sheet output path Z, as indicated by solid line in FIG. 5, during a sheet flipping output operation in which sheet 40 is turned upside down and output to output tray 58. Controller may cause the motor to accommodate engagement portion 72 into accommodation hole 66, as indicated by dashed lines in FIG. 5, during an output operation in which sheet 40 is output to output tray 58 without being flipped over or turned upside down.

Referring to FIG. 7B, when image forming apparatus is in operation, a linear distance L2 between output rollers 34 and engagement portion 72 may be smaller than dimension L1 of sheet 40 in the output direction. When leading end 40*a* of sheet 40 in the output direction is received by engagement portion 72 and trailing end 40*b* of sheet 40 is held between output rollers 34, sheet 40 may flex and may form a bow protruding away from connecting plate 20 with respect to a vertical line B, as shown in FIG. 8C.

Referring to FIG. 5, an angle β between engagement surface 72*a* and vertical line B may be set between 0 and 90 degrees during the sheet flipping output operation, such that engagement portion 72 may reliably engage and receive leading end 40*a* of sheet 40. When rigidity of sheets 40 is high, angle β may be set to a smaller angle to prevent leading end 40*a* from passing over engagement portion 72. When rigidity of sheets 40 is low, angle β may be set to a larger angle to prevent leading end 40*a* from bending.

Drive portion 74 may comprise a motor. In another embodiment, drive portion 74 may comprise an electromagnetic solenoid. Referring to FIG. 6, controller 36 of main unit 18 may be connected to a cable 78 of network 14 through which a print job signal generated in personal computers 16 may be transmitted to controller 36. The print job signal may comprise one of a flipping signal indicating a sheet flipping output operation and a non-flipping signal indicating an output operation in which the sheet is not flipped. The flipping signal may comprise an angle signal indicating the degree of angle β, as shown in FIG. 5.

When controller 36 receives the flipping signal, controller 36 may transmit a flipping control signal to drive portion 74 of engagement mechanism 24. Drive portion 74 may move engagement portion 72 to protrude engagement portion 72 toward sheet output path Z and angle β may be set based on the angle signal.

When engagement portion 72 protrudes into sheet output path Z and print preparation completes in image forming portion 32, feed roller 30 may feed sheets 40 accommodated in sheet accommodating portion 28 to image forming portion 32 one at a time, as shown in FIG. 7A. An image may be formed on a surface of sheet 40 based on image information transmitted from personal computer 16. Sheet 40 containing an image formed thereon may be fed by feed roller 30 to output rollers 34. Then, sheet 40 may be fed downward by output rollers 34 and output through output opening 42.

Sheet 40 may be fed through output opening 42 to reach engagement portion 72, as shown in FIG. 7B. Leading end 40*a* of sheet 40 in the output direction may engage or contact engagement portion 72 while trailing end 40*b* of sheet 40 in the output direction may be held between output rollers 34, because linear distance L2 may be smaller than dimension L1. Conveying force from output rollers 34 may be applied to sheet 40 and may flex sheet 40. sheet 40 may flex and form a bow protruding away from connecting plate 20 with respect to vertical line B, as shown in FIG. 8C.

When sheet 40 is flexed, the center of gravity of sheet 40 may move toward sheet receiving portion 22 side with respect to vertical line B, e.g., left side in FIG. 8C. and may pass over engagement portion 72. A restoring force may be generated in sheet 40 to return sheet 40 to its former non-flex state. When trailing end 40*b* of sheet 40 in the output direction is released from output rollers 34, sheet 40 may flip over, by its own weight and the restoring force, with leading end 40*a* as a pivot point, as shown in FIG. 8D. Thus, sheet 40 may be output to output tray 58 with a printed surface facing toward the output tray 58. Sheet 40 may slide down with the weight of sheet 40 along the angled upper surface of output tray 58. Trailing end 40*b* of sheet 40 may be received by extended portion 60.

Figure 9:
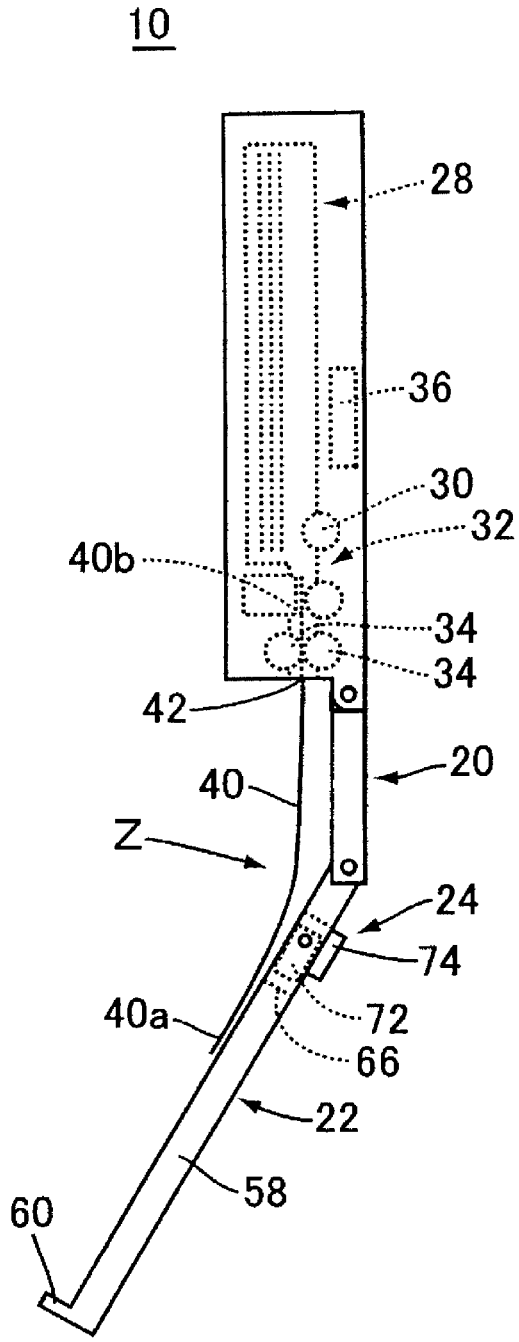
FIG. 9 is a schematic depicting a non-sheet-flipping output operation of the image forming apparatus according to the embodiment of FIG. 1.

When controller 36 receives the non-flipping signal, controller 36 may transmit a non-flipping control signal to drive portion 74. Drive portion 74 may move engagement portion 72 from sheet output path Z to accommodation hole 66. As shown in FIG. 9, leading end 40*a* of sheet 40 may not engage engagement portion 72. Sheet 40 may be output to output tray 58 with a printed surface facing away from output tray 58.

By moving engagement portion 72 between a position in which engagement portion 72 protrude into sheet output path Z and a position in which engagement portion 72 is accommodated into accommodation hole 66, image forming apparatus may selectively perform the sheet flipping output operation and the non-sheet-flipping output operation without a special sheet output path or an extra drive mechanism to turn sheets 40.

Connecting plate 20 may function as the flexing direction regulating device and may regulate the flexing direction of sheets 40. In another embodiment, output rollers 34 or a guide may function as an output direction regulating device and may guide sheets 40 slightly toward sheet receiving portion 22, e.g., left side in FIG. 3, deviating from the directly downward direction.

Protrusion of engagement portion 72 toward sheet output path Z or accommodation of engagement portion 72 into accommodation hole 66 may change based on a print job signal. In another embodiment, protrusion of engagement portion 72 toward sheet output path Z or accommodation of engagement portion 72 into accommodation hole 66 may be changed manually.

Figure 10:
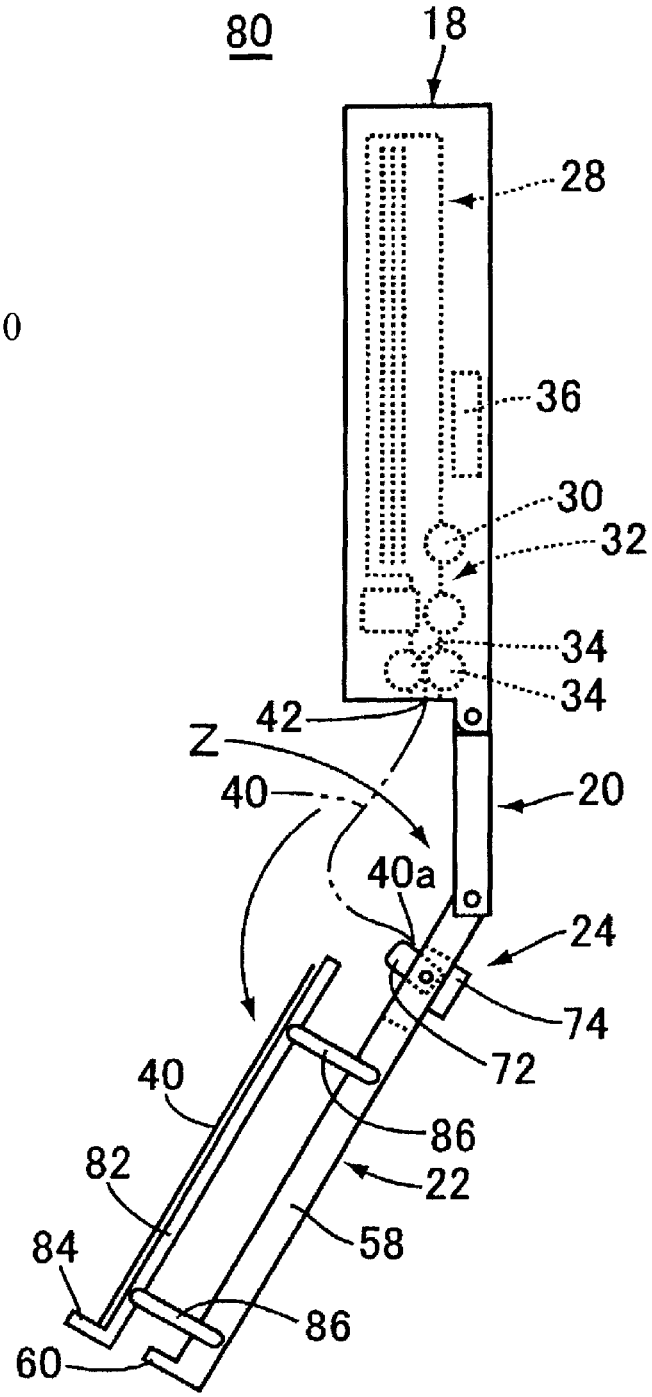
FIG. 10 is a schematic depicting a sheet flipping output operation of an image forming apparatus according to another embodiment of the invention.
Figure 11:
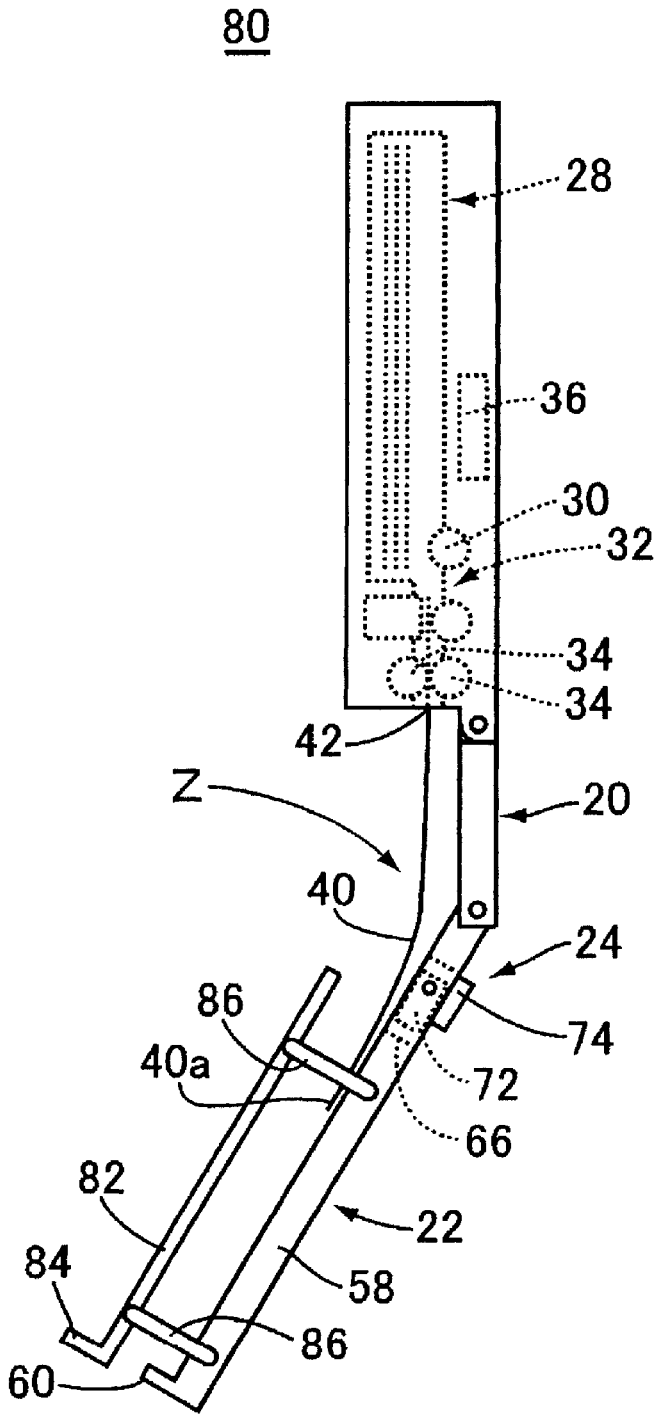
FIG. 11 is a schematic depicting a non-sheet-flipping output operation of the image forming apparatus according to the embodiment of FIG. 10.
Figure 12:
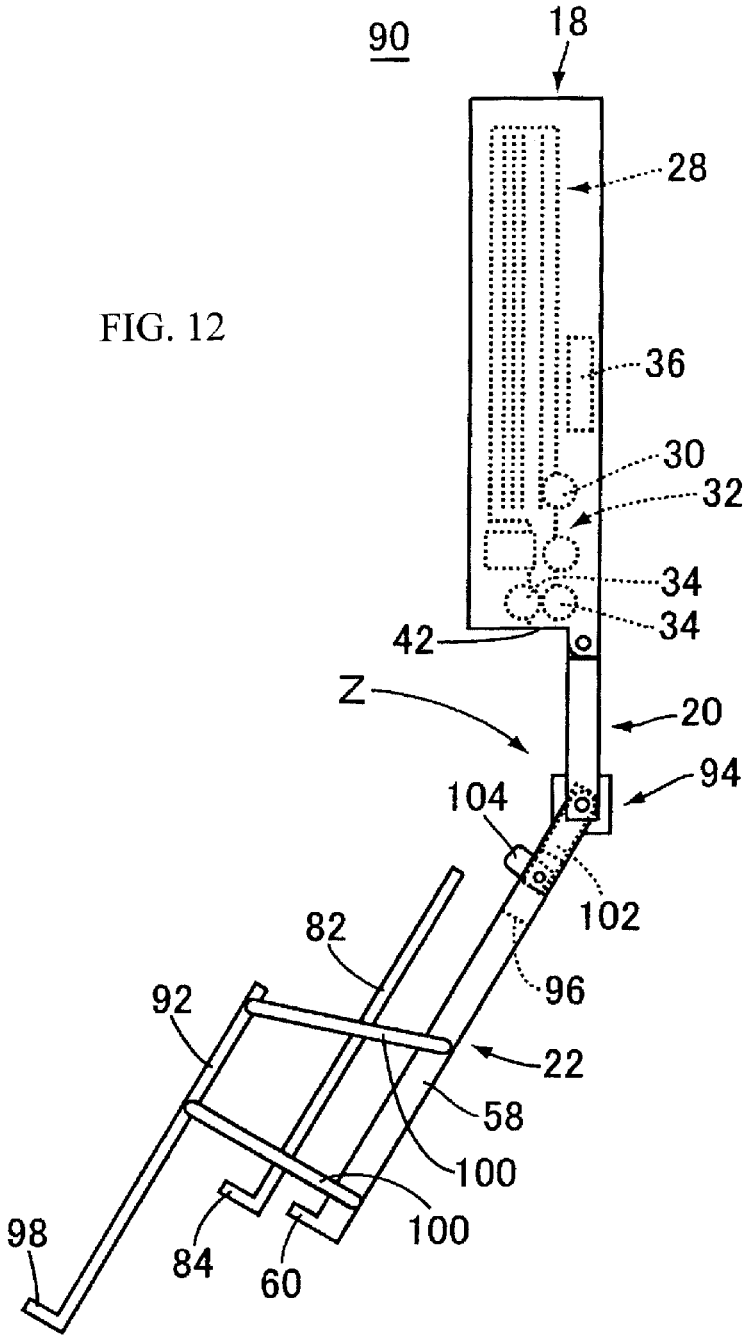
FIG. 12 is a side view of an image forming apparatus according to yet another embodiment of the invention.

Referring to FIGS. 10 and 11, an image forming apparatus 80 may comprise a second output tray 82. Second output tray 82 may be a plate member configured to receive sheets 40 flipped or turned upside down by engagement portion 72. An extended portion 84 configured to receive lower ends of sheets 40 may extend from an upper surface of output tray 82 at its the lower end. Output tray 82 may be removably attached to output tray 58 via an attachment member 86. Second output tray 82 may be positioned to receive sheets 40 that are flipped over. More specifically, second output tray 82 may be disposed in a position below engagement portion 72 and facing the upper surface of output tray 58.

When controller 36 receives the flipping signal, engagement portion 72 may protrude to sheet output path Z and sheet 40 may be flipped over with leading end 40*a* engaging engagement portion 72, as shown in FIG. 10. Sheet 40 may be output to second output tray 82 positioned over output tray 58.

When controller 36 receives the non-flipping signal, engagement portion 72 may be accommodated into accommodation hole 66, as shown in FIG. 11. Leading end 40*a* of sheet 40 may not engage engagement portion 72, and sheet 40 may be output to output tray 58 positioned under second output tray 80 with the printed surface facing away from output tray 58. Thus, sheets 40 that are flipped and sheet 40 that are not flipped may be output into second output tray 82 and output tray 58, respectively.

Referring to FIGS. 12-16, an image forming apparatus 90 may comprise a third output tray 92. Image forming apparatus 90 may further comprise an engagement mechanism 94 with adjustable positions, and an accommodation hole 96 corresponding to engagement mechanism 94.

Third output tray 92 may be a plate member configured to receive sheets 40 that are flipped over. An extended portion 98 may extend from an upper surface of third output tray 92 at its lower end and may be configured to receive lower ends of sheets 40. Third output tray 98 may be removably attached to output tray 58 together with second output tray 82, via an attachment member 100. Third output tray 92 may be disposed at a positioned to reliably receive sheets 40 that are flipped over. Third output tray 92 may be disposed at a position below an engagement portion 104 and the upper portion of second output tray 82. A portion of third output tray 92 may face a portion of the upper surface of output tray 82.

Figure 13:
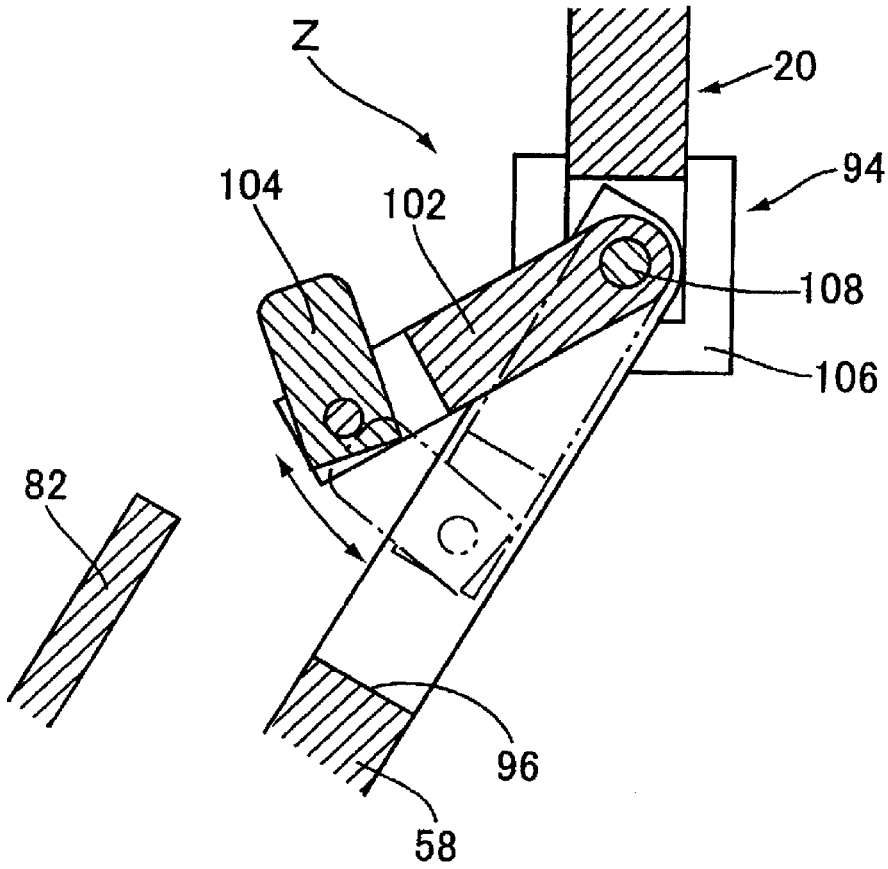
FIG. 13 is an enlarged cross-sectional view of an engagement mechanism of the image forming apparatus according to the embodiment of FIG. 12.

Referring to FIG. 13, engagement mechanism 94 may comprise an arm member 102 pivotally disposed in sheet output path Z, an engagement portion 104 pivotally disposed at an end of arm member 102, and a drive portion 106 configured to drive arm member 102 and engagement portion 104. A shaft 108 of arm member 102 may be coupled to connecting plate 20 or output tray 58. Drive portion 106 may be configured to drive arm member 102 and engagement portion 104 such that arm member 102 and engagement portion 104 may separately move in desired directions at desired angles. As drive portion 106 pivotally moves arm member 102, engagement portion 104 may move between positions each corresponding to one of the positions of second output tray 82 and third output tray 92.

Figure 14:
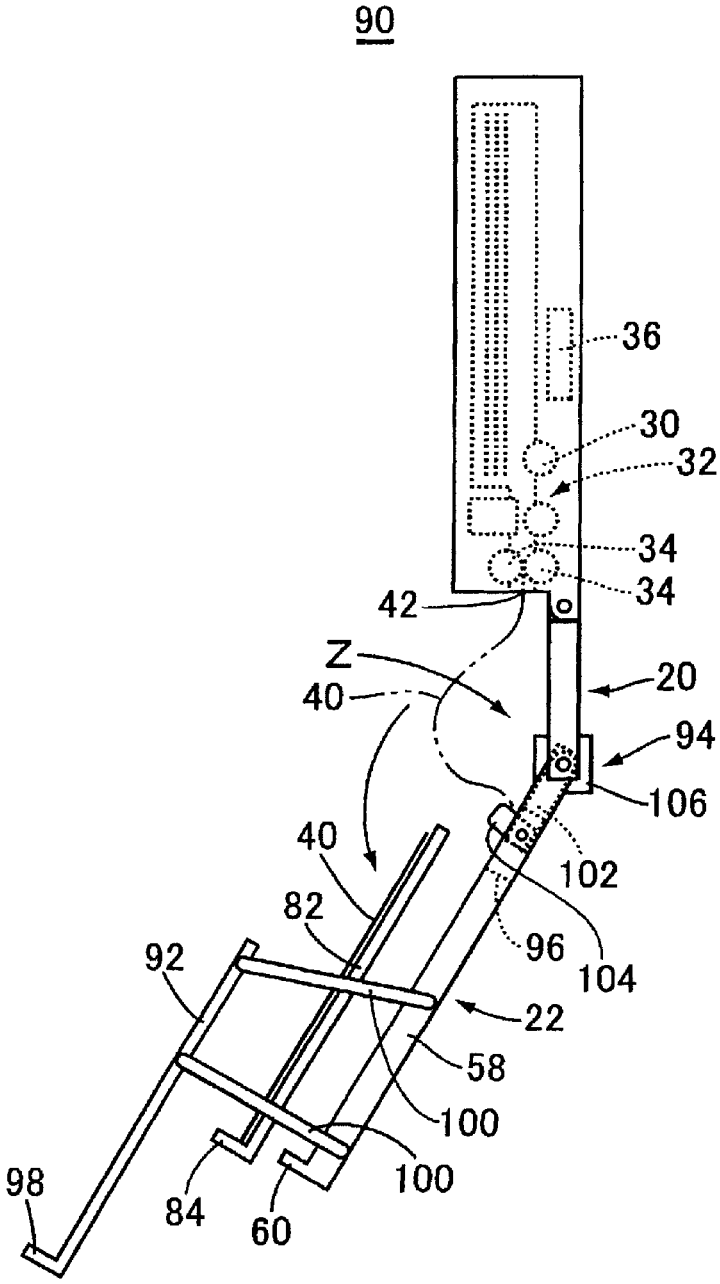
FIG. 14 is a schematic depicting a sheet flipping output operation of the image forming apparatus according to the embodiment of FIG. 12 in which a sheet is output to a second output tray.
Figure 15:
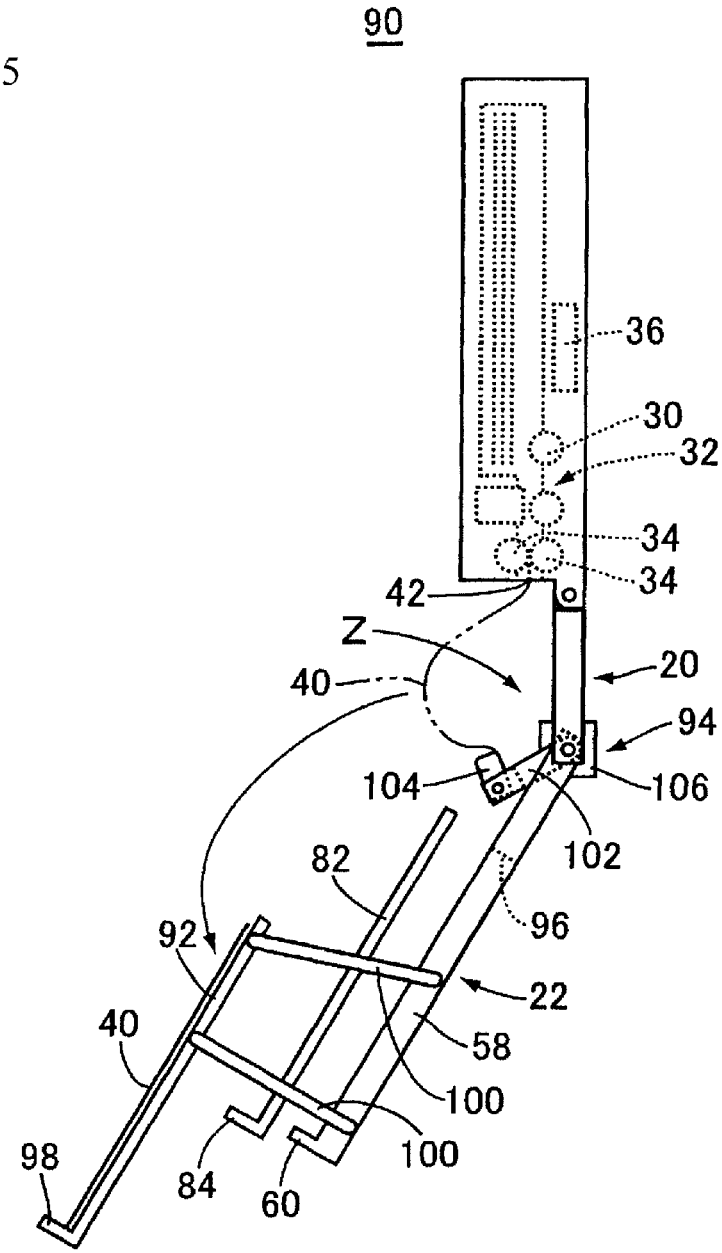
FIG. 15 is a schematic depicting a sheet flipping output operation of the image forming apparatus according to the embodiment of FIG. 12 in which a sheet is output to a third output tray.

One of output trays 92, 82 and 58 may be selected for a print job. When second output tray 82 is selected, arm member 102 may support engagement portion 104 at a position near the upper surface of output tray 58, as shown in FIG. 14. When third output tray 92 is selected, engagement portion 104 may pivotally move upward, as shown in FIG. 15, and engagement portion 104 may be supported at a predetermined position to output sheet 40 to third output tray 92.

Figure 16:
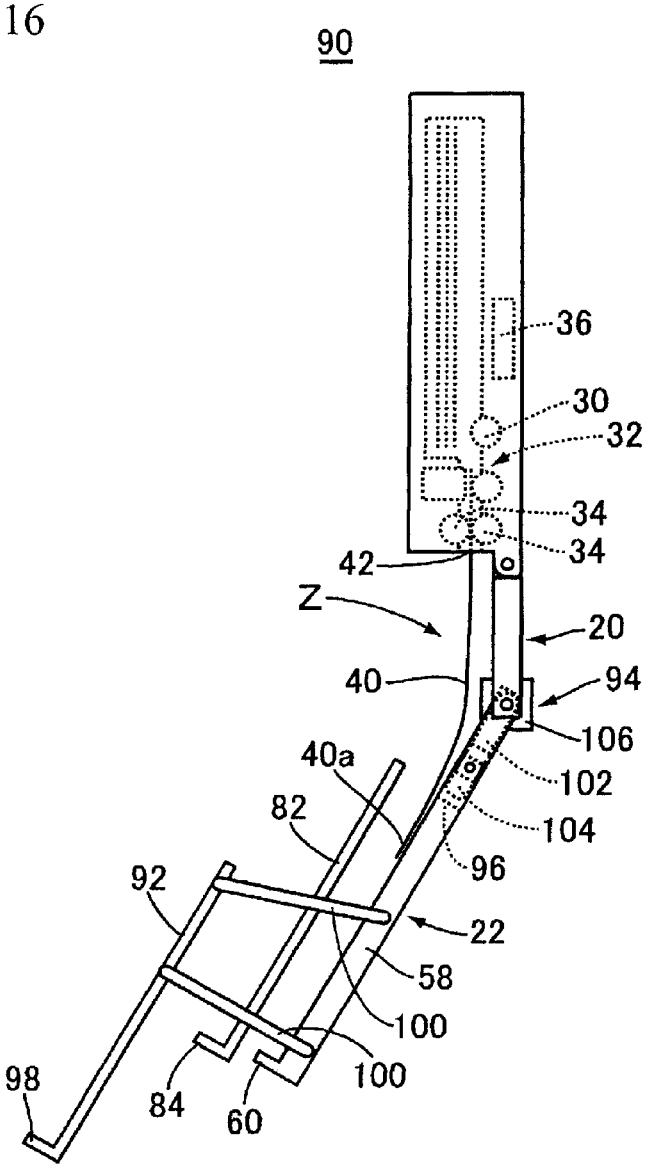
FIG. 16 is a schematic showing a non-sheet-flipping output operation of the image forming apparatus according to the embodiment of FIG. 12.

In an output operation in which a sheet is not flipped, arm member 102 and engagement portion 104 may be accommodated into accommodation hole 96 formed in output tray 58, as shown in FIG. 16. Leading end 40*a* of sheet 40 in the output direction may not engage engagement portion 104 and sheet 40 may be output to output tray 58 with the printed surface facing away from output tray 58. Sheets 40 may be sorted to second output tray 82, third output tray 92, and output tray 58. Sheets 40 that are flipped may be sorted into one of second output tray 82 and third output try 92.

In another embodiment, three or more output trays configured to receive sheets 40 may be disposed over output tray 58. Sheets 40 that are flipped may be sorted into one or more of the three or more output trays.

While the invention has been described in connection with various exemplary structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. An image forming apparatus comprising:

an image forming portion configured to form an image on a surface of a sheet having a leading end and a trailing end opposite the leading end;

a feeding device configured to feed the sheet in a sheet feeding direction and to output the sheet through an output opening positioned in the image forming apparatus and downstream from the feeding device in the sheet feeding direction;

an output direction regulating device configured to guide the sheet in an output direction as the sheet is output through the output opening;

a sheet receiving portion positioned downstream of the output opening in the sheet feeding direction; and an engagement portion positioned in a portion of a sheet output path downstream from the output opening and upstream from the sheet receiving portion in the sheet feeding direction and configured to selectively move between at least a first position and a second position, wherein when the engagement portion is in the first position, the engagement portion engages the leading end of the sheet when the sheet reaches the engagement portion, and when the engagement portion is in the second position, the engagement portion does not engage the sheet when the sheet reaches the engagement portion, wherein when the engagement portion is in the first position, the engagement portion is configured to engage the leading end of the sheet before the trailing end passes the feeding device, and the sheet receiving portion is configured to receive the sheet after the engagement portion engages the leading end of the sheet, and wherein the engagement portion is configured to alter an orientation of the sheet, such that the trailing end of the sheet is positioned further downstream in the sheet feeding direction than the leading end of the sheet when the sheet receiving portion receives the sheet.

2. The image forming apparatus of claim 1, further comprising a flexing direction regulating device positioned between the feeding device and the sheet receiving portion along the sheet feeding direction, and configured to regulate a flexing direction of the sheet when the leading end of the sheet engages the engagement portion.

3. The image forming apparatus of claim 1, wherein the engagement portion is configured to alter an orientation of the sheet when the engagement portion is in the first position.

4. The image forming apparatus of claim 1, wherein the output direction is a vertically downward direction.

5. The image forming apparatus of claim 1, wherein at least one of the feeding device and the output direction regulating device comprises a pair of output rollers configured to output the sheet through the output opening while holding the sheet between the output rollers.

6. The image forming apparatus of claim 1, wherein the sheet receiving portion comprises a plurality of output trays, and the engagement portion comprises an arm member which is pivotally disposed adjacent to the sheet output path and is configured to selectively move engagement portion between a plurality of positions, wherein each of the plurality of positions corresponds to one of the positions of the plurality of output trays.

7. The image forming apparatus of claim 6, wherein the sheet is sorted into one of the plurality of output trays based on the position of the engagement portion.

8. The image forming apparatus of claim 1, wherein the sheet receiving portion comprises an output tray disposed at an angle such that a lower portion of the output tray is further from the engagement portion in a horizontal direction than a top portion of the output tray, and wherein the output tray comprises an extended portion configured to receive a lower end of the sheet.

9. The image forming apparatus of claim 1, wherein when the engagement portion moves to the first position, the engagement portion is configured to engage and hold the leading end of the sheet, and the feeding device is configured to pinch and exert a conveying force in the sheet feeding direction on the sheet to flex and form a bow section in the sheet, thereby moving a center of gravity of the sheet toward the sheet receiving portion and the feeding device is configured to subsequently cause the sheet to pivot about the leading end of the sheet when the feeding device releases the sheet.

10. The image forming apparatus of claim 1, wherein the engagement section comprises an engagement surface configured to contact the leading end of the sheet and form an engagement angle with the sheet output path, and wherein the engagement angle is adjusted based on a rigidity of the sheet.

11. The image forming apparatus of claim 1, wherein the receiving portion is configured to fold and cover the image forming apparatus when the image forming apparatus is in a non-operating state.

12. The image forming apparatus of claim 1, wherein the engaging portion does not overlap the sheet output path in a direction perpendicular to the sheet feeding direction.

* * * * *